United States Patent [19]

Curtis

[11] Patent Number: 4,747,598

[45] Date of Patent: May 31, 1988

[54] RACKET FRAME HAVING INTERIORLY LOCATED STRINGING LUGS

[75] Inventor: Michael E. Curtis, Wakefield, England

[73] Assignee: Dunlop Limited a British Company, United Kingdom

[21] Appl. No.: 748,910

[22] Filed: Jun. 26, 1985

[30] Foreign Application Priority Data

Jul. 17, 1984 [GB] United Kingdom ..... 8418191

[51] Int. Cl.[4] ..... A63B 49/10

[52] U.S. Cl. ..... 273/73 C; 273/DIG. 1; 273/DIG. 2; 273/DIG. 10; 273/DIG. 11; 273/DIG. 7; 273/DIG. 23

[58] Field of Search ..... 273/73 C, 73 D, 73 H, 273/73 G, 73 K, 73 F, 73 R

[56] References Cited

U.S. PATENT DOCUMENTS

| | | | |
|---|---|---|---|
| 1,470,878 | 10/1923 | Robinson | 273/73 D |
| 1,523,638 | 1/1925 | Freedlander et al. | 273/73 C X |
| 1,606,022 | 11/1926 | Gallandet | 273/73 H |
| 2,230,177 | 1/1941 | Caines | 273/73 D |
| 3,083,968 | 4/1963 | Takahashi | 273/73 R |
| 3,547,440 | 12/1970 | Deer | 273/73 D |
| 3,874,667 | 4/1975 | Gallagher et al. | 273/73 H X |
| 3,966,207 | 6/1976 | Pass | 273/73 D |
| 3,981,502 | 9/1976 | Portz . | |
| 4,297,308 | 10/1981 | Popplewell | 273/73 C X |
| 4,331,331 | 5/1982 | Rodgers, Jr. | 273/73 K |
| 4,365,806 | 12/1982 | Reid et al. | 273/73 D X |
| 4,440,392 | 4/1984 | Popplewell | 273/73 D X |

FOREIGN PATENT DOCUMENTS

| | | | |
|---|---|---|---|
| 0040551 | 11/1981 | European Pat. Off. . | |
| 2200754 | 4/1974 | France . | |
| 2217035 | 9/1974 | France . | |
| 28838 | of 1902 | United Kingdom | 273/73 H |
| 533728 | 2/1941 | United Kingdom . | |
| 828685 | 2/1960 | United Kingdom . | |
| 1238182 | 7/1971 | United Kingdom . | |
| 1271582 | 4/1972 | United Kingdom . | |
| 2015886 | 5/1982 | United Kingdom . | |

*Primary Examiner*—Anton O. Oechsle
*Assistant Examiner*—Matthew L. Schneider
*Attorney, Agent, or Firm*—Stevens, Davis, Miller & Mosher

[57] ABSTRACT

The invention relates to a frame for a games racket e.g. tennis, of the type made as a hollow injection moulding of reinforced thermoplastics material. The frame has attachments for stringing in the form of a series of discrete lugs moulded integrally with the walls of the hollow frame and so positioned that the racket strings in their desired positions do not pass to the outer periphery of the head. The discrete lugs may for example be around the inner periphery of the head of the frame and each contain an integrally-moulded circumferential bore for string passage. The frame may be made by injection moulding around a fusible core and the shape of the core required to give the desired lugs provides strong resistance to movement under the injecting pressures hence giving improved product uniformity.

6 Claims, 6 Drawing Sheets

RACKET FRAME HAVING INTERIORLY LOCATED STRINGING LUGS

This invention relates to games rackets and particularly to games racket frames of hollow construction that are formed by injection moulding of thermoplastics material.

Games racket frames, e.g. for tennis, squash or badminton, have traditionally been made of wood. A wooden racket of good quality is a laborious article of manufacture involving considerable time and skill and hence expense. Moreover being of natural materials it is not possible to avoid variations from product to product that ought in fact to be the same. For some years now tubular metal rackets have been commercially available, at least for tennis and badminton, and although having some advantages over wood they are not universally acceptable. More recently reinforced plastics rackets have appeared on the market. In order to have acceptable strength at the required weights these rackets have necessarily been made of hollow frame form. The assignee's UK Pat. No. 2015886 and U. S. equivalent U.S. Pat. No. 4,440,392 describes a development in which an injectionmoulding technique is used to make a thermoplastic hollow racket frame.

In UK Pat. No 2015886 there is described and claimed a games racket frame in which the frame comprises a head and a shaft, at least the head being a hollow injection moulding of thermoplastics material reinforced with short filament reinforcing mateiral, in which the wall of the moulding which lies at the outer circumference of the head is joined to the wall which lies at the inner circumference of the head by an internal support means and the stringing holes in the head pass through the support means, the walls and support means of the moulding being integrally-formed. By "thermoplastics material reinforced with short filament reinforcing material" is meant a reinforced thermoplastics material in which the reinforcements are in the form of short discrete lengths of fibre-reinforcing material randomly dispersed in the thermoplastics resin matrix. It also describes a method of making such frames utilizing a fusible core.

Prior to that invention, hollow plastics rackets had been made by the more laborious technique of assembling long reinforcing fibres around a mandrel by hand. The difficulties of such a building technique were eliminated by the invention of No. 2 015 886 which enabled the much more commercially attractive injection moulding technique to be employed.

The products of No. 2 015 886 have internal reinforcing means, usually in the form of hollow pillars, passing from the frame wall at the outer circumference of the head to the wall at the inner circumference of the head. These pillars allow passage of the racket strings through the hollow frame and strengthen the frame to withstand the considerable loads that can be imposed by the strings particularly during play.

The present invention aims to provide an alternative construction of hollow injection-moulded racket frame utilizing a simpler and hence more efficient moulding technique.

Accordingly the invention in one aspect provides a games racket frame comprising a head and a shaft at least the head of which is a hollow injection-moulding of thermoplastics material reinforced with short filament reinforcing material, as herein defined, the frame being provided with stringing means adjacent the inner periphery of the head whereby racket strings when in the desired strung positions do not pass through the hollow frame to the outer periphery, in which the stringing means defining the stringing holes are formed integrally with the moulding in the form of a series of discrete lugs.

In another aspect the invention provides a games racket comprising a strung racket of the immediately preceding paragraph.

It is clearly advantageous for the strings not to have to appear at the outer periphery of the strung frame and so it will be appreciated that 'adjacent the inner periphery' can be interpreted broadly while still obtaining such advantages. In other words suitable stringing means could, for example, lie about halfway between the inner and outer peripheries or, possibly, even nearer the outer periphery.

In a first embodiment the stringing means are provided in the form of a series of lugs integrally-moulded around the inner periphery of the head of the frame, each lug containing a bore or channel for passage of strings, the bores running substantially circumferentially around the inner periphery of the head. The bores can conveniently be formed integrally as part of the moulding process.

In a second embodiment the stringing means are provided in the form of a series of lugs integrally-moulded inside the hollow head of the frame with access to those lugs for stringing being provided by corresponding, integrally-moulded apertures in the inner periphery of the head. In this embodiment the strings can pass around the lugs rather than through them. Instead of a series of apertures in the inner periphery of the head, it may be found convenient to provide a continuous opening running around the inner periphery.

In another modification of this second embodiment, the outer periphery of the head may also be provided with a series of slots giving access to the inside of the hollow structure. These slots can be positioned to aid the stringing of the racket frame. Thus, although it is not desired that the strings in their final positions in the strung frame pass to the outer periphery, it may be found advantageous during the actual stringing process to be able to pass a string right through the head from inside the head loop to outside the head loop. The string can then be passed back inside the hollow structure to its desired path and final position.

Racket frames of this invention may incorporate, if desired, various of the features described in U.K. Pat. No. 2,015,886. Thus, the plastics material used is preferably reinforced with from 10% to 40% by weight of carbon fibres based on total weight of the reinforced matrix. Alternatively similar amounts of glass or aromatic polyamide (e.g. Kevlar—Registered Trade Mark) or mixtures of any reinforcing fibres may be used.

Although polyamides are the preferred plastics material, others, e.g. polycarbonate, acrylonitrilebutadiene-styrene (ABS), acetal resin and poly(phenylene oxide) (PPO) may be used.

The actual dimensions of the hollow frame will depend of course on the type of racket, e.g. whether for tennis, squash or badminton. Similarly, the wall thickness will be governed by strength and weight requirements for the particular game. The average skilled man of the art will readily be able to decide suitable dimensions for his particular requirements. As an example only, a useful wall thickness may be 2.5 mm for a tennis racket.

The transverse sectional shape of the frame may be any desired shape, for example, circular, oval or rectangular. The latter may be preferred as its boxlike section can give very high stiffness and strength to weight ratios.

Racket frames of the invention can conveniently be made by an injection-moulding process involving a destructible core and it is preferred to use a core that can be melted below the softening point of the set plastics material of the frame. The use of a core of this type in the moulding of a hollow article made from thermoplastics material is known and is described for example in British Patent Specification No. 828,685. Basically, the principle involved is to make an appropriately-shaped core of fusible material (metal in British Pat. No. 828,685) whose melting point is lower than the temperature achieved in the injection-moulding cycle. Due to the thermal conductivity of the core, the moulding is effected before the metal reaches its melting point. Alternatively, the core can be cooled by heat exchange during the moulding cycle to prevent its melting. Once the moulded article has set, the temperature can be raised sufficiently to melt the core but insufficiently to melt or distort the moulding.

Accordingly in a further aspect, the invention provides a method of making a frame for a games racket, the frame comprising a head and a shaft, in which at least the head is formed by injecting around a fusible core a thermoplastics material reinforced with short filament reinforcing material, as defined above, the core having a melting point below the injection temperature and being shaped so that the injected thermoplastics material provides a series of stringing lugs moulded integrally with the wall of the head, the lugs lying adjacent the inner periphery of the head, allowing the moulding to set, raising the temperature to an amount sufficient to melt the core but insufficient to melt or deform the moulding and removing the molten core.

The core is preferably of fusible metal although other low-melting point materials could be used. Suitable metals include, for example, Wood's Metal (which is an alloy of lead, tin, bismuth and cadmium) and a variety of commercially-available types sold under proprietory trade names.

The core may be made, for example, by gravity-casting or die-casting, the latter being preferred.

Embodiments of the invention are now described by way of examplification only with reference to the accompanying drawings in which.

Figure 1:
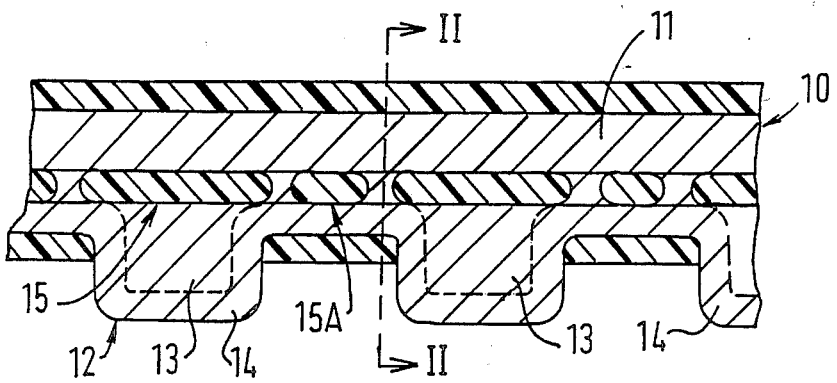
FIG. 1 is a diagrammatic representation showing in part section a portion of one form of the head of a moulded frame of the invention still in position around its fusible core. (It will be appreciated that the portion is shown in straight line form for convenience rather than in its actual curved form corresponding to the loop of the head)

Referring to FIGS. 1 to 4, a cast fusible mould core 10 has the shape of the desired internal configuration of the head of the racket frame. It has a main elongated body 11 and is formed with skirt 12 around its inner periphery, the skirt having a castellated shape whereby a series of spaced lugs 13 are provided. The innermost edge of the skirt, i.e. innermost with respect to the loop of the head of the racket frame, has a continuous thickened portion or bead 14 (see in particular FIG. 1). The skirt, additionally, is provided with a series of slots 15 and 15A lying adjacent the inner periphery of the main body 10.

Figure 2:
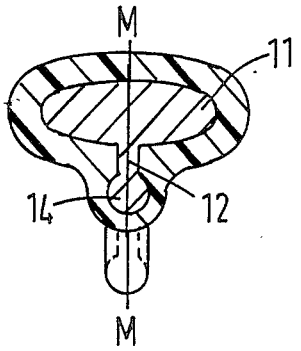
FIG. 2 is a transverse section on line II—II of FIG. 1.
Figure 3:
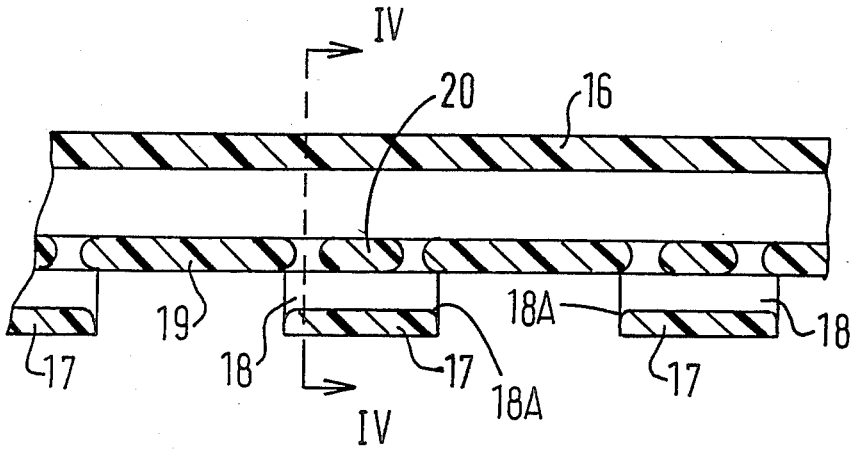
FIG. 3 is a similar view to that of FIG. 1 but showing the frame with the core removed.
Figure 4:
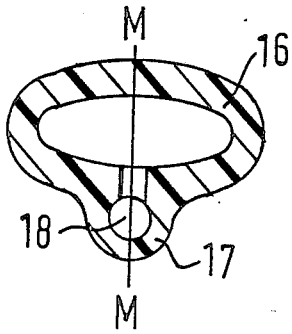
FIG. 4 is a transverse section on line IV—IV of FIG. 3.

Core 10 is placed in a suitable injection mould so that a cavity is defined between the core and the mould walls corresponding exactly to the moulded frame required. Conventional spacing means (not shown) can be utilized. The mould parting line is conveniently chosen to be along line M—M FIGS. 2 and 4. Thermoplastics material is then injected to form the frame. The injected material is allowed to set and then the core is melted out. FIGS. 1 and 2 illustrate the stage after setting and prior to melting out the core.

The head of the frame comprises a hollow tubular main body 16 with a series of integral lugs 17, a lug 17 being positioned between a pair of correspondings lugs 13 of the core. The lugs 17 each have an integrally-moulded channel 18 with radiussed edges 18A. Strengthening braces 19 and 20 have been formed along the length of the body by means of the appropriately shaped slots 15 and 15A respectively in the core.

When the core is melted out the racket frame remaining is provided with integral stringing means in the form of bored or channelled lugs 17, with the bores 18 running circumferentially around the inner periphery of the head.

Referring to FIGS. 5 to 8, cast fusible mould core 21 has an elongated body 22 with a continuous skirt portion 23. Skirt portion 23 has an enlarged peripheral region 24 along its length as an aid to locking the core tightly in position when it is placed in the mould. Body 22 has a series of slots 25 with radiussed edges 25A, along its length.

Figure 5:
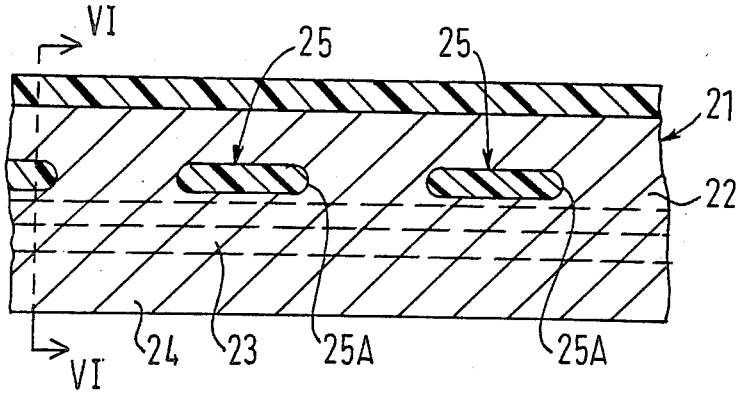
FIG. 5 is a similar view to FIG. 1 but of an alternative frame of the invention still in position around its fusible core.
Figure 6:
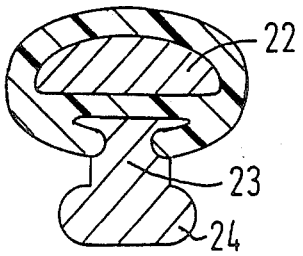
FIG. 6 is a transverse section on line VI—VI of FIG. 5.
Figure 7:
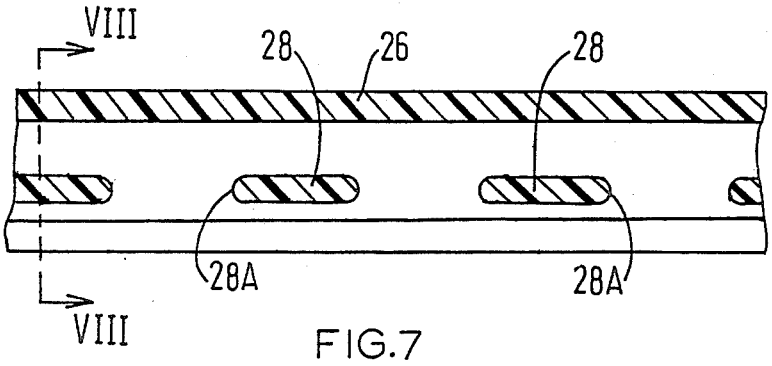
FIG. 7 is a similar view to that of FIG. 5 but showing the frame with the core removed.
Figure 8:
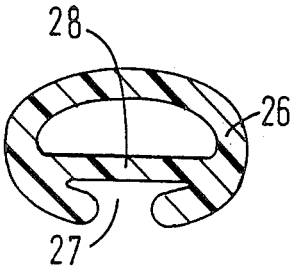
FIG. 8 is a transverse section on line VIII—VIII of FIG. 7.

When placed in a suitable injection mould, thermoplastics material is injected around the core to form the frame. FIGS. 5 and 6 illustrate the stage after setting of the thermoplastics material but prior to melting out the core.

The frame head comprises a hollow tubular body 26 having a continuous slot 27 running around its inner periphery. This has been formed by skirt 23 of the core. Inside the hollow tubular body is formed a series of lugs 28 corresponding to slots 25 in the core. Lugs 28 have radiussed edges 28A and in conjunction with slot 27 provide a convenient stringing means for the frame.

Referring now to FIGS. 9 to 12, a cast fusible core has an elongated body 30 with two perforated skirts 31 and 32, one positioned at the outer periphery of the core and the other at the inner periphery, i.e. with respect to the intended head loop.

Both skirts are provided with an enlarged peripheral portion, 33 and 34 respectively, for the purpose of aiding the locking of the core tightly in the desired position in an injection mould during injection of the plastics material. Additionally, both skirts are perforated by being provided along their lengths with a series of slots 35 and 36 respectively.

Figure 9:
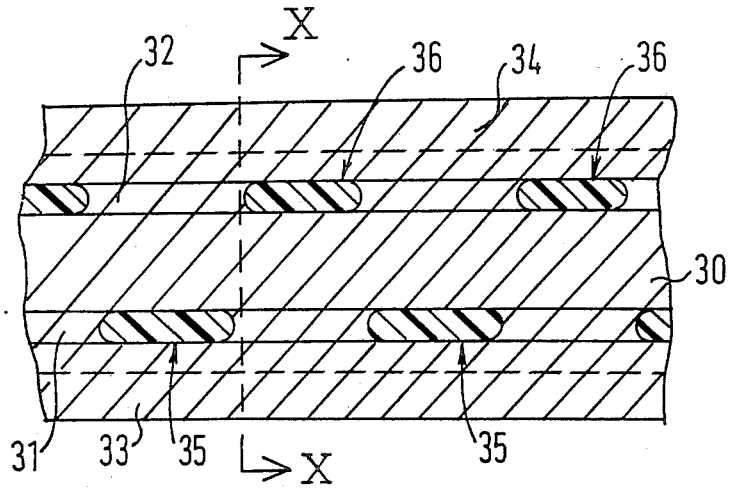
FIG. 9 is a similar view to FIGS. 1 and 5 but showing yet another frame of the invention still in position around its fusible core.
Figure 10:
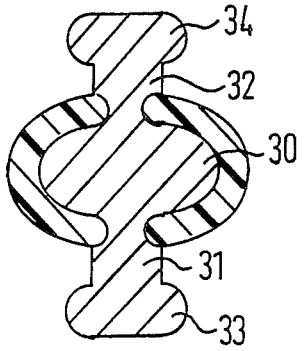
FIG. 10 is a transverse section on line X—X of FIG. 9.
Figure 11:
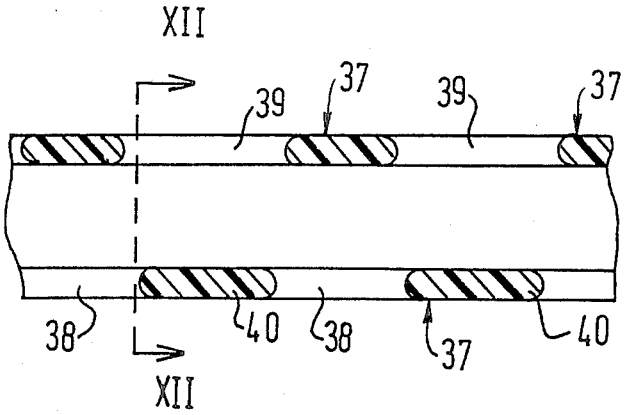
FIG. 11 is a similar view to that of FIG. 9, showing the frame with the core removed.
Figure 12:
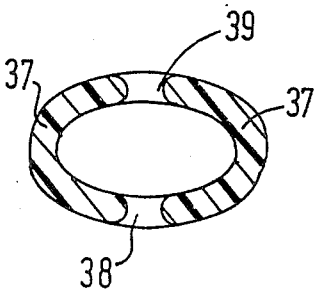
FIG. 12 is a transverse sectin on line XII—XII of FIG. 11.

Again when core 30 is placed in a suitable injection mould, thermoplastis material is injected around it and allowed to set to form the desired head of the frame. FIGS. 9 and 10 illustrate this stage, i.e. prior to melting out the core.

The frame head comprises a hollow tubular body 37 that has a series of slots 38 in its inner periphery and a series of slots 39 in its outer periphery, these slots corresponding to the non-perforated portions of the respective skirts of the core.

The portions 40 of the body 37, i.e. the portions lying between adjacent pairs of slots 38, provide lugs around which the desired strings of the racket frame can be attached. Slots 39 in the outer periphery aid the actual stringing process in that a string can be passed into one slot 38, through the tubular body and out through slot 39. Its direction can then be turned to pass back into the hollow body and out through a slot 38 adjacent the one it entered so that it passes around lug 40 but does not appear at the outer periphery in the finished strung form.

Many variations of slots, channels and lugs can of course be devices while still falling within the ambit of the present invention. For example, one further embodiment could embrace in effect a combination of features shown in FIGS. 7 and 8 on the one hand and FIGS. 11 and 12 on the other hand. This embodiment would be of hollow-tubular form and have a series of slots (39) in its outer wall and a corresponding series of slots (38) in its inner wall. It would additionally have a series of lugs (corresponding to 28 of FIG. 7) integrally formed inside the tube.

It will be apparent that the fusible cores employed can conveniently be shaped so that the shaft and handle portion of the racket frame are formed as an integral moulding with the head. Shaft and handle shapes as desired can readily be formed but have not been described above as they can be designed as required by the skilled man of the art.

Attention is drawn in particular to the shape of the cores described in the above embodiments. It will be noted that the cores provide by virtue of their shapes extremely strong self-locating means in the mould (see parts 14—FIG. 2, 24—FIG. 6 and 33 and 34—FIG. 10). Thus the cores are tightly locked in place in the injection mould and are ideally suited to withstand the high pressures of the injection of molten thermoplastics material without deflection or movement from the precise desired position in the mould. Additional locating means, e.g. locating pins in planes normal to the plane of opening of the injection mould are therefore not necessary so that a simpler mould tooling and improved product quality can be achieved. The invention enables high quality products to be made of greater uniformity of wall thickness than was hitherto possible. This, equally, enables thinner-walled products to be made to a higher standard of uniformity and hence enables lighter products to be made.

I claim:

1. A games racket frame comprising a head and a shaft at least the head of which is a hollow injection-moulding of thermoplastics material reinforced with short filament reinforcing material, at least the head being of generally C-shaped cross section with the open end of the C-shape defining an inner periphery of the head, said head having an outer periphery opposite said inner periphery, said outer periphery being provided with a series of apertures giving access to the inside of the hollow head, said head provided with stringing means adjacent the inner periphery for holding a racket string, said stringing means being unitary with and bridging the open end of the generally C-shaped cross section, wherein the spaces between adjacent stringing means define stringing holes in the head and at least one racket string strung on the head through the stringing holes and about the stringing means such that the string does not pass through the hollow frame to the outer periphery of the head, in which the stringing means defining the stringing holes are formed of one piece with the moulding in the form of a series of discrete lugs.

2. A games racket frame according to claim 1 in which the series of discrete, integrally-moulded lugs lies inside the hollow head of the frame, an integrally-moulded continuous opening in the inner periphery of the head providing access to the lugs for stringing purposes.

3. A games racket frame according to claim 1, in which the reinforcing material is selected from the class consisting of carbon fibres, glass fibres, aromatic polyamide fibres and mixtures thereof.

4. A games racket frame according to claim 1, in which the thermoplastics material us selected from the class consisting of polyamide, polycarbonate, acrylonitrile-butadiene-styrene, acetal resin and poly(phenylene oxide).

5. The games racket of claim 1, wherein the generally C-shaped cross section is comprised of walls and wherein the walls of the generally C-shaped cross section of the head are arcuate.

6. The games racket of claim 1, wherein the generally C-shaped cross section is comprised of walls and wherein the walls of the generally C-shaped cross section of the head are planar.

* * * * *